US005221173A

United States Patent [19]

Barnes

[11] Patent Number: 5,221,173

[45] Date of Patent: Jun. 22, 1993

[54] MULTI-VEHICLE TRANSPORT SYSTEM FOR BULK MATERIALS IN CONFINED AREAS

[76] Inventor: Kevin P. Barnes, P.O. Box 586, Running Springs, Calif. 92382

[21] Appl. No.: 644,580

[22] Filed: Feb. 25, 1991

[51] Int. Cl.[5] ..... B65F 9/00; B65B 21/02

[52] U.S. Cl. ..... 414/346; 414/408; 414/498

[58] Field of Search ..... 414/346, 345, 340, 350, 414/352, 343, 385, 389, 391, 399, 406, 408, 498, 474, 492, 396

[56] References Cited

U.S. PATENT DOCUMENTS

| | | | |
|---|---|---|---|
| 3,270,902 | 9/1966 | Breault | 414/406 |
| 3,325,024 | 6/1967 | Shubin | 414/406 |
| 3,584,749 | 6/1971 | Parello | 414/343 |
| 3,817,415 | 6/1974 | Lewis | 414/399 |
| 3,905,497 | 9/1975 | Stedman et al. | 414/408 |
| 4,096,959 | 6/1978 | Schaffer | 414/408 |
| 4,113,120 | 9/1978 | Pickrell | 414/350 |
| 4,128,182 | 12/1978 | Pickrell | 414/406 |
| 4,152,979 | 5/1979 | Schmidt | 414/406 |
| 4,699,557 | 10/1987 | Barnes | 414/408 |
| 4,934,896 | 6/1990 | Quinto | 414/408 |

FOREIGN PATENT DOCUMENTS

| | | | |
|---|---|---|---|
| 078011 | 5/1983 | European Pat. Off. | 414/408 |
| 1373638 | 2/1988 | U.S.S.R. | 414/408 |

*Primary Examiner*—Joseph F. Peters, Jr.
*Assistant Examiner*—R. B. Johnson
*Attorney, Agent, or Firm*—Robbins, Dalgarn, Berliner & Carson

[57] ABSTRACT

A multi-vehicle transport system for the transportation of bulk material such as trash and the like is disclosed. The multi-vehicle transport system includes a primary load vehicle operable to go to remote areas and discharge the contents of a standard bin into a hopper, and a secondary load vehicle operable using a hydraulically actuated fork lift system to lift and discharge the contents of the hopper from the primary load vehicle into the secondary load vehicle. A method of multi-vehicle transport of bulk materials is also described.

3 Claims, 2 Drawing Sheets

MULTI-VEHICLE TRANSPORT SYSTEM FOR BULK MATERIALS IN CONFINED AREAS

BACKGROUND OF THE INVENTION

The present invention relates to a multi-vehicle transport system for the movement of bulk materials where the materials are stored or maintained in confined areas; and more particularly to a multi-vehicle transport system for waste disposal.

In the trash pick up industry, it is common to encounter areas, either residential or industrial, which have restricted access. In these restricted access areas, the large trash receiving collecting and/or compacting vehicle cannot go to the site where the trash bins are located in order to lift them and then deposit the trash into a trash collecting vehicle.

As a result, it has been the practice to have work crews who go to the remote site and then by hand, roll the trash bin to an area where the trash collection vehicle can receive it and where it is then emptied. The empty bin is then returned to its original spot in a second labor-intensive trip.

Alternately, some companies have utilized a pickup truck with pickup prongs thereon which can then go into the limited access area, pick up the remote bin, carry the bin outwardly to the area of the trash pickup truck, empty the trash bin, and then again return the now empty bin back to its original spot. Obviously, either method requires two return trips to each site where the bin is stored.

U.S. Pat. No. 4,113,120 to John W. Pickrell, issued Sep. 12, 1978, discloses a trash container with a bustle and bustle actuator which is removably carried on a vehicle with a tiltable chassis. A container is moved on and off the chassis through the tilting of the chassis and a crusher is pivotally mounted on the trash container to force trash downwardly into the container providing both movement of the trash and compaction. Independent racks are provided to support the containers when they are not on the vehicle and a hauling truck having a tiltable container support is adapted to carry a plurality of these containers.

The device as disclosed by Pickrell in U.S. Pat. No. 4,113,120, further discloses a small transport dump truck having a trash container mounted upon it that is operable to haul and compact the refuse. Further, a larger pickup vehicle is also described which is operable to pick up the compacted trash from the smaller compacting vehicle. In the Pickrell system, the trash container while it is operable to be off-loaded from the transporting vehicle, it is not physically transported to the larger trash-containing vessel. Extensive man power would be expended, and time consumed in the processing of trash using the Pickrell system because the Pickrell system does not allow the larger trash collecting vehicle to directly remove the trash bin from the smaller collecting vehicle, empty it and then return the trash bin to the collection vehicle.

It is in the interests of economy to drive onto properties having limited access where larger transport vehicles cannot go. In the waste management business locations requiring small truck service include; narrow driveways, congested areas, cul de sacs, steep driveways and buildings having waste collection being located in covered parking facilities.

U.S. Pat. No. 4,067,464 to Melvin H. Parks et al. issued Jan. 10, 1978, discloses a refuse compaction and ejection system for a location having restricted vertical angular movement due to a lack of free space between the vehicle and the bin. In the Parks et al. device, a body slide-lift mechanism for shifting the refuse storage compartment rearward in combination with vertical movement to adjust the level of refuse ejection to desired height is disclosed. The Parks et al. device is directed to a rearward displacement movement of the waste compaction compartment away from the body obstructing access to the bin. Further, this system requires the main collection vehicle to back up to the compaction vehicle in order to transfer the remotely collected waste.

SUMMARY OF THE INVENTION

The present invention is a multi-vehicle transport system for collection of waste materials from a confined area. The present invention solves the problems of large waste material handling vehicle's inability to enter confined areas thus requiring large work crews and multiple trips to transport waste materials. This system discloses a waste material handling process wherein a single round trip is made by the operator of the collection vehicle collecting the waste material or trash from each site which is remotely situated.

The invention provides a multi-vehicle transport system for waste materials wherein a primary load vehicle having a motorized truck body supports a detachable hopper wherein the hopper has at least two fork pockets. Affixed to the truck body Is a hydraulically actuated tipper having at least two forks wherein these forks are operable to slidably interfit fork pockets situated on a standard refuse bin. The tipper is, therefore, operable to pick up a bin and dump said bin into the hopper. There is also provided a secondary loading vehicle having a storage capacity greater than the storage capacity of the primary load vehicle. The secondary load vehicle includes a hydraulically actuated fork lift operable to slidably interfit the fork pockets of the hopper of the primary load vehicle and is further operable to deposit the contents of the primary load vehicle hopper into the secondary vehicle hopper. A method of multi-vehicle transport for bulk materials is also disclosed.

BRIEF DESCRIPTION OF THE DRAWINGS

A complete understanding of the present invention and of the above advantages may be gained from a consideration of the following description of the preferred embodiments taken in conjunction with the accompanying drawings in which.

DETAILED DESCRIPTION

Figure 1:
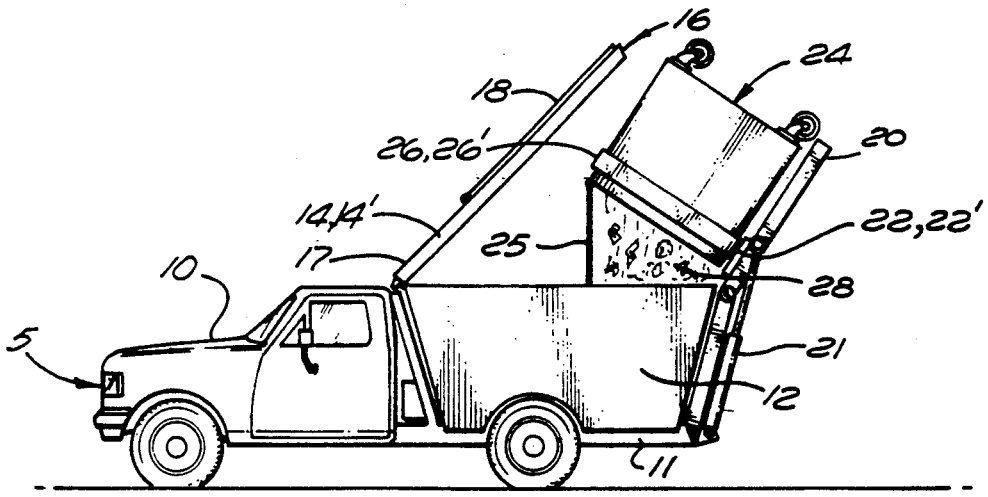
FIG. 1 is a side view, schematic representation of the primary load vehicle unloading a solitary bin in a confined area.

The invention, a multi-vehicle transport system for waste materials in confined areas, includes a primary load pickup vehicle which has a trash collecting or waste material collecting hopper seated upon a bed wherein the hopper can be releasably affixed to the bed and can be easily lifted and again returned to the bed. The hopper has a pair of fork-pocket openings, one opening which is spaced on one side of the hopper and the other opposing so that pickup prongs or forks from the secondary collecting vehicle can be inserted therein.

Affixed to the rear of the bed of the primary load pickup vehicle is a forklift-type mechanism having two forks extending from it. These forks are designed to insert into a trash bin of the type normally used in residences and industry for the collection of refuse or any other standard bin suitable for use in the collection of waste material.

When the bin is picked up by the forks of the primary load pickup vehicle and overturned with a hydraulic actuator also affixed to the bed of the primary load pickup vehicle, it will dump its contents into the primary load pickup vehicle.

After dumping the contents of the bin into the hopper of the primary load pickup vehicle, the bin is returned to its regular position operable to be filled again by the end user.

The foregoing steps can be repeated a multiplicity of tides until the primary load vehicle hopper is full. That is, for example, the primary load vehicle may be driven along a residential street to several homes to collect refuse or driven to other remote sites having bins before returning to the secondary load vehicle.

Finally, after the hopper is filled, the primary load pickup vehicle is driven to the site of the secondary load vehicle. Forks on the secondary load vehicle are inserted into openings within the hopper of the primary load pickup vehicle. The hopper is lifted from the bed of the primary load pickup vehicle and the hopper trash contents is then dumped into the centralized storage bin of the secondary load vehicle. Thereafter, the hopper of the primary load pickup vehicle is returned to its position on the bed of the primary load pickup vehicle for trips to other end use's collection sites.

As can determined from the structure described, only a single round trip is necessary for the operator of the primary load pickup vehicle to collect bulk materials or trash from an individual site.

Benefits of this multi-vehicle transport system include; fewer equipment use hours, lower labor costs due to reduced crews as compared to those now manning standard collection vehicles, less fuel consumption by the smaller primary load vehicles and enlargement of the vehicle driver pool available to the industry by utilizing smaller vehicles for which more drivers would qualify.

Additionally, the use of smaller transport vehicles results in reduced property damage for the property owner as compared to previous larger collection vehicles burdened with heavy beds traversing the property.

In FIG. 1 a side view schematic representation of the primary load pickup vehicle 5 unloading a solitary bin 24 in a confined area. The primary load pickup vehicle 5 comprises a motorized truck 10 having a bed 11 and a hopper 12, of predetermined configuration detachably affixed upon the bed 11. This nopper 12 has a primary lid 16 made of fork pockets and a top panel and a secondary lid 18 with two fork pockets 14, 14' along the edge of the secondary lid. These fork pockets make a frame upon which secondary lid 18 is mounted. Mounted between the two fork pockets 14, 14' is a rigid lid 17 acting as a cross-member. A tipper means 20 is driven by, a hydraulic actuator 21 such that two fork beams 22 and 22' on the tipper mechanism 20 are operable to slidably interfit fork pockets 26, 26' on a standard bin 24 (FIG. 4) having a lid 25. The primary load vehicle 5 with its motorized truck 10 and bed 11 supporting the hopper 12 is preferably less than six feet high to enable the unit to enter enclosed, covered parking areas. As disclosed in FIG. 1, primary load pickup vehicle is not a complete system. After collection of the bulk material 28, the primary load pickup vehicle 5 travels to a collection point where it intercept a secondary load pickup vehicle of a much larger configuration.

Figure 2:
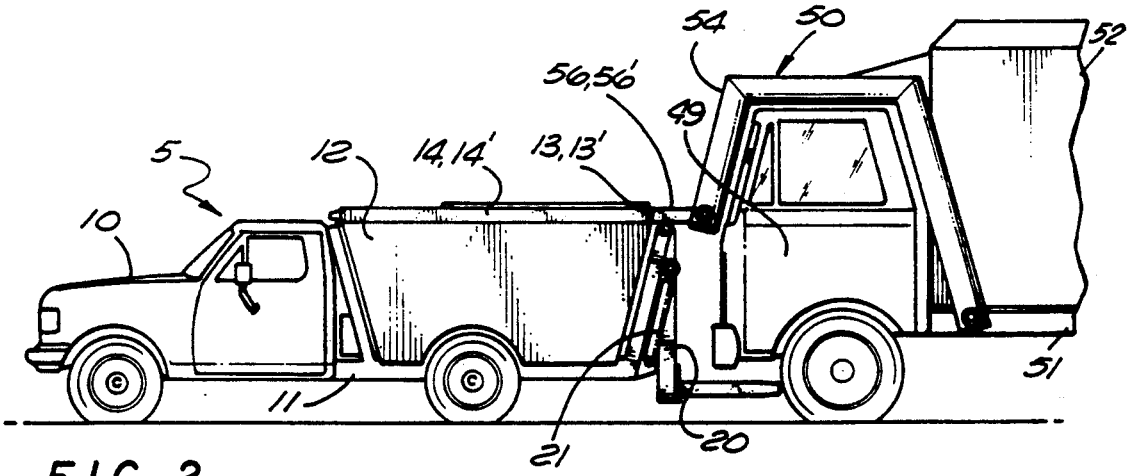
FIG. 2 is a side view, schematic representation of the primary load vehicle in conjunction with the secondary load vehicle prior to unloading of the primary load vehicle.

FIG. 2 is a side view schematic representation of the primary load vehicle 5 in conjunction with the secondary load vehicle 50 prior to the unloading of the hopper 12. The primary vehicle 5 is disposed in front of the secondary load vehicle 50 so that the rear or the hopper 12 is facing the front or truck portion 49 of the secondary load vehicle 50. This truck portion 49 is motorized to facilitate the transport of the collected material 28 to a depository site. The secondary vehicle 50 as shown in FIG. 2 has a bed 51 operable to support a centralized storage bin 52 which is a larger storage facility than the hopper 12. This centralized storage bin 52 can be a compactor body of, for example, any state of the art front loading refuse truck. A lifting mechanism 54 is shown in the downward position over the motorized truck portion 49 of the secondary load vehicle 50. Two lifting forks 56 and 56' are operable to slidably interfit the fork pockets 14, 14' through the holes 13, 13' (FIG. 6) of the hopper 12 without interfering with the tipping mechanism 20 and hydraulic actuator 21 for the tipper mechanism 20. We refer to and incorporate by the reference as just one example the "Refuse Collection Vehicle" described in U.S. Pat. No. 4,699,557, issued Oct. 13, 1987 to the same inventor of this multi-vehicle transport system.

Figure 3:
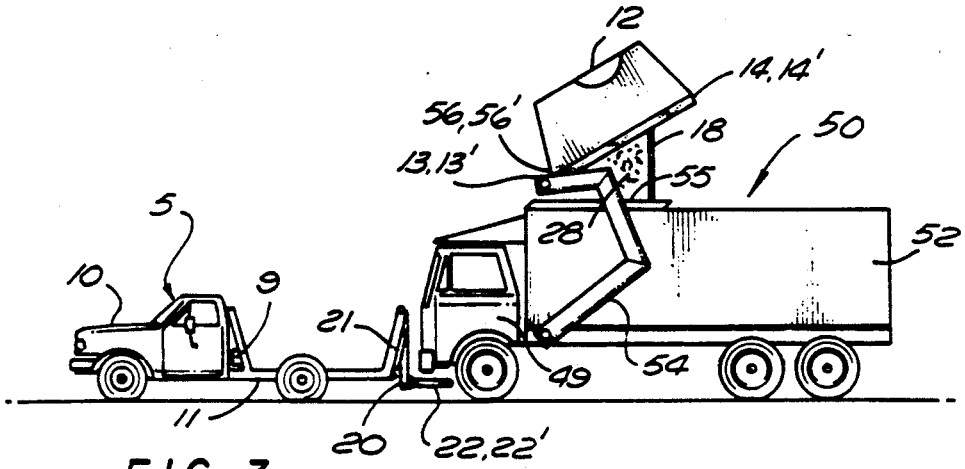
FIG. 3 is a side view, schematic representation of the primary load vehicle being unloaded by its hopper into the secondary load vehicle.

FIG. 3 is a side view schematic representation of the secondary load vehicle 50 in the process of unloading the primary load vehicle 5. The hopper 12 is detached from the bed 11 and lifted over the motorized secondary truck portion 49 by the lifting forks 56, 56' which is inserted into the holes 13, 13' defined by the gussets 30 (FIG. 5) and received within the fork pockets 14, 14'. The lifting forks 56, 56' by extending through the gussets 30 and into the forks pockets 14, 14' act as beams locking the primary lid assembly 16 to the hopper 12 to prevent the primary lid 16 from opening while trash is being discharged as shown in FIG. 3.

As can be seen in FIG. 3, the lifting mechanism 54 of the secondary load vehicle 50 lifts the hopper 12 over and above an open depository area 55 wherein a secondary lid 18 of the hopper 12 opens due to the force of gravity to allow the discharge of the waste material or trash 28. As the bulk material 28 falls into larger collecting body 52 of the secondary vehicle 50, no human personnel need exit either the primary or secondary vehicles 5 and 50, respectively. For the process as disclosed in FIG. 3, only two individuals are required for this multi-vehicle bulk material transport system, a driver for the primary load pickup vehicle 5 and a driver for the secondary vehicle 50. After the contents of the hopper 12 is discharged into the larger collection body 52 of the secondary load vehicle 50, the hopper 12 is then repositioned back upon the bed 11 of the primary load vehicle 5 and is further supported by tipper frame 9. The primary load vehicle 5 is now operable, by driving forward, to disengage forks 56, 56' from fork pockets 14, 14' and holes 13, 13'.

Figure 4:
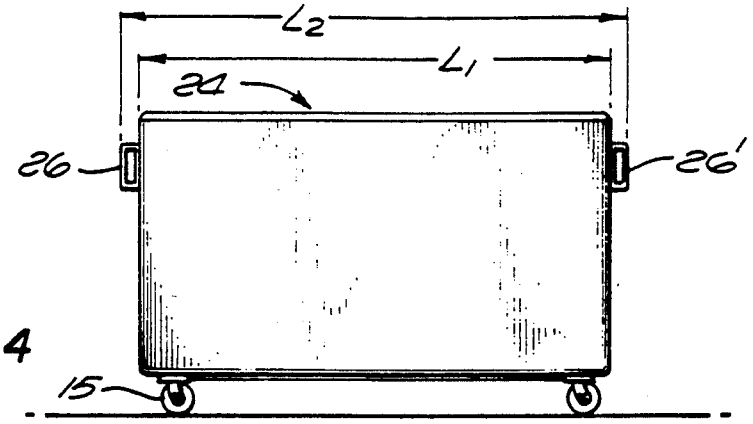
FIG. 4 is a front view, schematic representation of the standard bin.

FIG. 4 is a front view schematic representation of a typical or standard bin 24 which has rollable wheels 15 attached to the base of the bin 24 and the two fork pockets 26 and 26' which receive the forks 22, 22' of the tipper mechanism 20 of this primary load vehicle 5. $L_1$ is the distance between the interior configuration of the typical bin 24 which would be for this example approximately 1.83 meters (6 feet), while the fork pockets extend an additional approximately 20.32 cm (8 inches) from the sides of the typical bin 24, for distance $L_2$.

Figure 5:
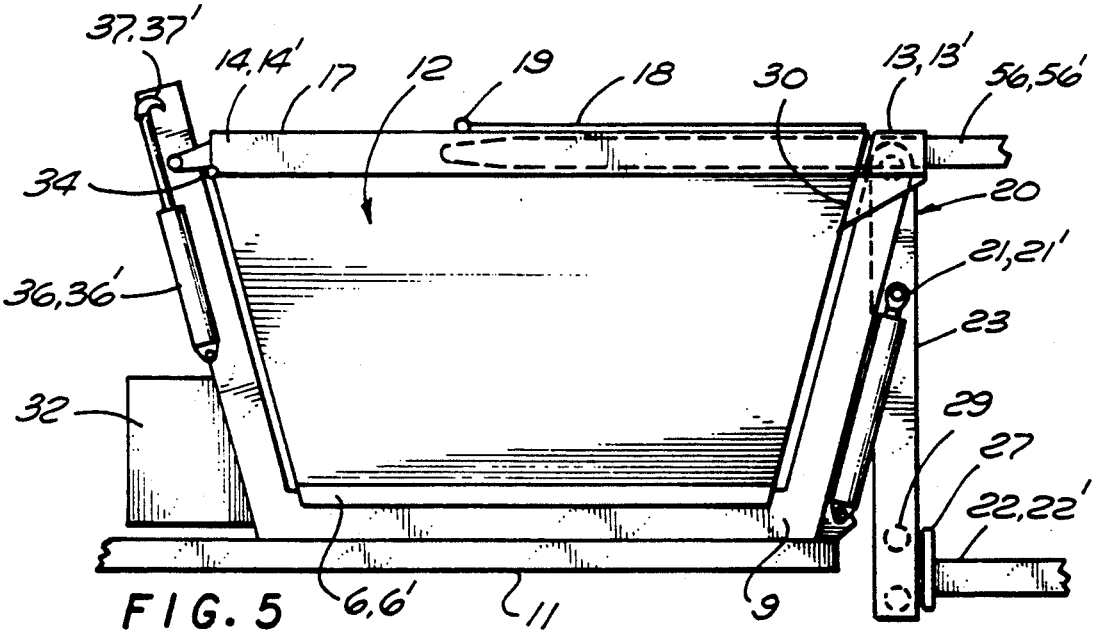
FIG. 5 is a schematic representation cross-section view of the hopper, bed, tipper and actuator of the primary load vehicle.

FIG. 5 is a schematic partial fragmented representation of the hopper 12 tipper 20, actuator 21 and bed 11 of the primary load vehicle 5. As can be seen in FIG. 5, the hopper 12 interfits slidably with channels 6, 6' on to the tipper frame 9 which rests upon the bed 11 of the truck portion 10. The tipper has hydraulic cylinders 21, 21' which are operable to raise or lower the tipper mast 23. Carriage rollers 29 fit within the tipper mast 23 to facilitate the movement of the carriage, 27 up the tipper mast 23 with attached forks 22, 22', during the course of unloading bin 24. A solid cover 17 resides between the fork pockets 14, 14'. A secondary lid 18 is secured by hinge 19 to pivot open and discharge trash as shown in FIG. 3. The hopper 12 is nested within the tipper frame 9 but allowing room for a hydraulic reservoir 32 to, drive the hydraulic cylinders 21, 21' as well as cylinders 36, 36'. The cylinder 36, 36' drive sliding catches 37, 37' pulling down the ends of the fork pockets 14, 14' of the primary lid assembly 16 pivoting, it on a hinge 34 to open the top of the hopper 12 as shown in FIG. 1. Gussets 30 for reinforcement and support of the fork pocket holes 13, 13' are welded to the hopper wall 40.

Figure 6:
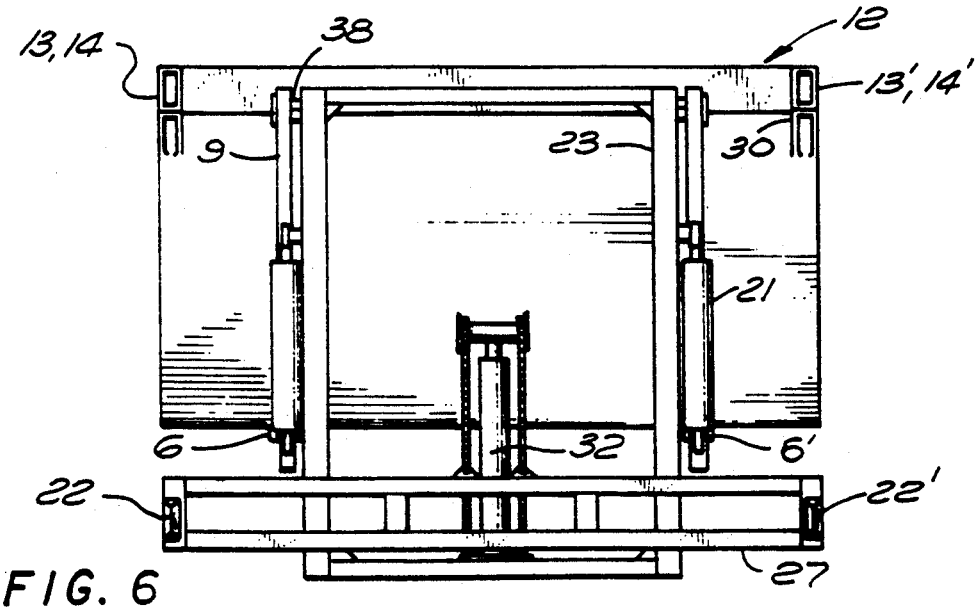
FIG. 6 is a schematic representation rear view of the hopper.

FIG. 6 is a rear view schematic representation of the hopper 12 showing in detail the hopper and beam relationship. Specifically, the hopper 12 has a tipper mast 23 and tipper frame 9 longitudinally surrounding the hopper 12.

The overall width of hopper 12 will preferably be 6'8" ($L_2$) in a typical trash collection system. This 6'8" size enables trash falling out of a standard 6 foot wide bin 24 to be captured easily when the primary lid assembly 16 is open. The distance between fork pockets 14, 14' is 6 feet ($L_1$) thereby funneling trash into a standard width refuse truck when the primary lid assembly is closed and locked within holes 13, 13' by the forks of the larger secondary vehicle. The fork lift cylinder and chain 32 which serve to unload the bin 24 are shown in FIG. 6. The tipper 20 pivots about pivot 38 when the bin 24 is lifted and emptied into the hopper 12 of the primary load vehicle 5.

As can be seen from the foregoing, there is provided a small hopper 12 which is transportable on a pickup truck bed into confined areas. The hopper 12 has a primary lid 16 which can be pivoted (FIG. 1) to provide an opening sufficiently large to receive the contents of a standard size trash bin (6 feet 8 inches). When filled, the hopper can be removed from the pickup truck by the forks on a typical front loading trash truck. The forks pass through an opening 13 in gussets 30 affixed to the hopper body 40 and into fork packets 14 to lock the primary lid in place on top of the hopper while allowing a secondary lid 18 to open and discharge the hopper 12 contents into the standard size opening (6 feet) on the typical front loading trash truck.

While particular embodiments of the invention have been shown and described, it will be obvious to those skilled in the art that the changes and modifications may be made without departing from the invention in its broader aspects and therefore the aim in the appended claims is to cover all such changes and modifications as followed in the true spirit and scope of the invention.

What is claimed:

1. A multi-vehicle trash collection system for emptying a plurality of standard sized trash containers located in confined areas and receiving said trash from said plurality of containers, said system comprising:

(A) a primary motorized trash collection vehicle having a bed means;

(B) hopper means having a body detachably supported on said bed means, said hopper means including:

(1) a primary lid means pivotally secured to said hopper means body and including a secondary lid pivotally secured thereto, (2) first and second fork pockets formed on opposite sides of said primacy lid, and (3) first and second gusset means secured to said hopper means body adjacent said first and second fork pockets and defining openings aligned with said fork pockets;

(C) first cylinder means affixed to said primacy vehicle for pivoting said primary lid to open said hopper and provide an opening sufficiently large enough to permit said standard sized containers to discharge trash therefrom into said hopper;

(D) tipper means having tow tipper forks for engaging said standard said containers, said tipper means being pivotally affixed to said primary vehicle;

(E) second cylinder means for pivoting said tipper means to empty the contents of said standard sized containers into said hopper when said primary lid is open;

(F) a secondary motorized trash collection vehicle having a storage compartment, said storage compartment having a capacity substantially greater than that of said hopper; and (G) secondary fork lift means affixed to said secondary vehicle and having first and second forks, said first and second forks being received by said openings in said gusset means and said fork pockets for locking said primary lid to said hopper means body while allowing said secondary lid to pivot open to discharge trash from said hopper into said storage compartment.

2. The multi-vehicle system as defined in claim 1 wherein said hopper means body has first and second opposed side walls and said first and second fork pockets are disposed inwardly of said first and second side walls.

3. The multi-vehicle system as defined in claim 2 wherein said cylinder means are hydraulically activated.

* * * * *

UNITED STATES PATENT AND TRADEMARK OFFICE

CERTIFICATE OF CORRECTION

PATENT NO. : 5,221,173

DATED : June 22, 1993

INVENTOR(S) : Kevin P. Barnes

It is certified that error appears in the above-identified patent and that said Letters Patent is hereby corrected as shown below:

| COLUMN LINE | |
|---|---|
| 2, 29 | "Is" should be --is-- |
| 3, 30 | "tides" should be --times-- |
| 3, 45 | "use's" should be --user's-- |
| 3, 46 | "as can" should be --as can be-- |
| 3, 61 | "beds" should be --loads-- |
| 3, 67 | "nopper" should be --hopper-- |
| 4, 16 | "intercept" should be --intercepts-- |
| 4, 47 | "is" should be --are--. |
| 5, 31 | after "to" <u>delete</u> the comma |
| 5, 33 | after "cylinders" insert --32 and-- |
| 5, 34 | "cylinder" should be --cylinders-- |
| 5, 35 | after "pivoting" <u>delete</u> the comma |
| 6, 27 | "primacy" should be --primary-- |
| 6, 32 | "primacy" should be --primary-- |

UNITED STATES PATENT AND TRADEMARK OFFICE

CERTIFICATE OF CORRECTION

PATENT NO. : 5,221,173
DATED : June 22, 1993
INVENTOR(S) : Kevin P. Barnes

It is certified that error appears in the above-indentified patent and that said Letters Patent is hereby corrected as shown below:

| Column | Line | |
|---|---|---|
| 6, | 37 | "tow" should be --two-- |

Signed and Sealed this

Twenty-second Day of February, 1994

*Attest:*

Bruce Lehman

BRUCE LEHMAN

*Attesting Officer*

*Commissioner of Patents and Trademarks*